US005660294A

United States Patent [19]

Schneider et al.

[11] Patent Number: 5,660,294

[45] Date of Patent: Aug. 26, 1997

[54] ROTATING CLOSURE FOR A METALLURGICAL VESSEL

[75] Inventors: Ralf Schneider, Mettmann; Wolfram Jung, Siegen; Hans-Joachim Paris, Düsseldorf, all of Germany

[73] Assignee: Mannesmann Aktiengesellschaft, Düsseldorf, Germany

[21] Appl. No.: 504,829

[22] Filed: Jul. 20, 1995

[30] Foreign Application Priority Data

Jul. 22, 1994 [DE] Germany ..... 44 26 720.7
Jul. 4, 1995 [DE] Germany ..... 195 25 917.3

[51] Int. Cl.[6] ..... B65D 51/18; B22D 41/14

[52] U.S. Cl. ..... 220/253; 215/309; 215/313

[58] Field of Search ..... 215/309, 313; 220/253

[56] References Cited

U.S. PATENT DOCUMENTS 2,961,228 11/1960 Moore ..... 220/253 X
3,855,997 12/1974 Sauer ..... 215/309 X
4,538,653 9/1985 Shea et al. ..... 220/253 X
4,993,573 2/1991 Freidel et al. ..... 215/309
5,299,608 4/1994 Bosyj ..... 215/309 X

FOREIGN PATENT DOCUMENTS 4231692 3/1994 Germany .

*Primary Examiner*—Stephen Cronin
*Attorney, Agent, or Firm*—Cohen, Pontani, Lieberman & Pavane

[57] ABSTRACT

A rotating closure device for a runout opening in a base of a metallurgical vessel for preventing access of gases reacting with a melt. The device includes an upper closure plate (3) positioned at an end side of a drain block (1) and a lower closure plate (4) at the outlet (2). The upper closure plate (3) is provided with at least two through-holes for meeting at least two channels (7, 8) in the drain block (1), which channels (7, 8) extend parallel to an axis of rotation of the device. The lower closure plate (4) is provided with at least one through-hole for meeting at least one channel (6) in the outlet. The at least two chapels (7, 8) meet at least one channel (6) via a connection between the upper and lower closure plates (3, 4).

15 Claims, 2 Drawing Sheets

ROTATING CLOSURE FOR A METALLURGICAL VESSEL

BACKGROUND OF THE INVENTION

1. Field of the Invention

The present invention relates to rotating closures for the discharge or runout opening in the base of a metallurgical vessel and, more particularly, to rotating closures which prevent entry of gases which may react with a melt.

2. Description of the Related Art

Rotating closures for covering the discharge opening in a base of a metallurgical vessel are well-known. For example, German Patent No. DE 42 31 692 C1 discloses a rotating closure having a stationary drain block positioned at the base of the metallurgical vessel and a runout sleeve having an inclined channel positioned within the drain block. An outlet is positioned opposite the stationary drain block and is rotatable about a vertical axis. A sleeve is inserted in this outlet, the shape of this sleeve being a mirror-inverted image of the runout sleeve. The runout sleeve and the sleeve of the outlet are in contact with each other at respective facing flat sides, i.e. in the region of their planar sealing surfaces. By rotating the outlet relative to the drain block, the through-openings, i.e. the mouths of both the channel of the drain sleeve and the sleeve of the outlet, can be made to more or less coincide in order to achieve various open positions for regulating the melt runout from the metallurgical vessel or can be held so as to be completely offset relative to one another in a closed position. The drain block, the two sleeves and the outlet are produced from conventional refractory materials. The rotation of the rotating closure is controlled by a motor, e.g. an electrical motor, via a gear unit.

In this prior art rotating closure, the two sleeves can be subject to sharply different degrees of heating during operation due to the inclined channel causing one-sided warping of the sleeves thus affecting the tightness of the sleeves in the region of the contact surfaces. A further disadvantage is that the high flow rates in the channel of the upper region of the rotating closure due to the cross sectional area of the channel generate a strong vacuum pressure causing air to be sucked in from the environment through the porous refractory material and to come into contact with the melt. This, in turn, often brings about unacceptable oxide formations in the melt. In order to prevent this, it is known to shield the rotating closure using a protective-gas shrouding. However, the use of such a protective-gas shrouding is very expensive.

It is thus desirable to provide a rotating closure which is able to effectively prevent the entry of gases which would react with the melt in a cost efficient manner.

SUMMARY OF THE INVENTION

The present invention is directed to a rotating closure device rotatable about an axis of rotation and covers a runout opening in a base of a metallurgical vessel. The closure device includes a drain block having two channels extending parallel to the axis of rotation, an upper closure plate having two through holes and positioned to provide a mating relationship between the two channels and the two through holes, an outlet having one channel and a lower closure plate having one through hole positioned between the upper closure plate and outlet to provide a mating relationship between the one through hole and the one channel in the outlet and the one channel in the outlet and the two channels in the drain block. The drain block may include more than two channels and the outlet may include more than one channel. The upper closure plate and lower closure plate may likewise include more than two and one through holes respectively.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, in which like numerals are used to denote like elements.

DETAILED DESCRIPTION OF THE PRESENTLY PREFERRED EMBODIMENTS

Figure 1:
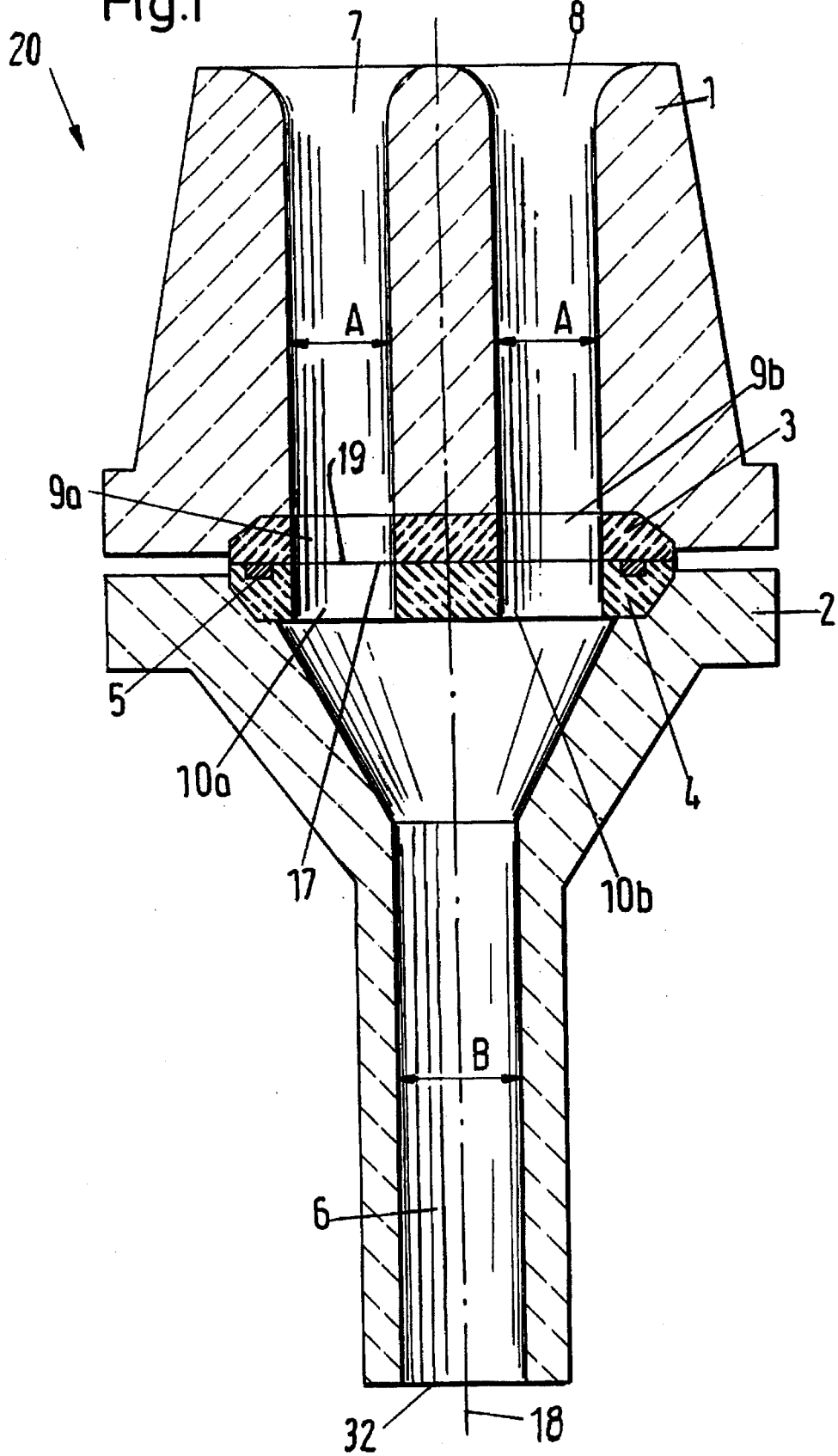
FIG. 1 shows a side cross-sectional view of a rotating closure according to the present invention for an intermediate vessel of a continuous casting installation for round or square cross sections.

The rotating closure according to the present invention is shown in FIG. 1 and indicated generally by the numeral 20. The closure 20 includes a drain block 1 and a corresponding outlet 2 arranged coaxially with one another. Both the drain block 1 and outlet 2 are preferably formed of conventional refractory materials. A lower closure plate 4 and an upper closure plate 3 each including a planar sealing surface 17, 19 respectively, are installed coaxially to a rotational axis 18 of the rotating closure 20 so as to contact one another along a region of their planar sealing surfaces 17. Unlike the drain block 1 and outlet 2, the closure plates 3, 4 are not formed of common conventional refractory material, but rather are preferably formed of a high-strength refractory material, the material preferably having a hardness of at least 2000 HV(Vickers Hardness). It is essential that the material forming the closure plates 3, 4 not only be sufficiently stable with respect to the anticipated operating temperature of the molten metal, but also have a high resistance to wear. In the presently described embodiment of FIG. 1 the outlet 2 and the lower closure plate 4 are rotatable about the axis 18 relative to the stationary drain block 1 and the upper closure plate 3. In the position shown in the drawing, the melt can run out of the metallurgical vessel (not shown) through the two channels 7, 8 which extend vertically downward as depicted in the FIG. 1, through the aligned through holes **9*a*, 9*b* in the upper closure plate 3, the through holes 10*a*, 10*b* in the lower closure plate 4 and through the channel 6 of the outlet 2 and a front opening 32 of the outlet 2** into its destination, e.g. an ingot mold.

In order to provide good sealing of the closure device 20 which prevents the entry of gases, the planar sealing surfaces 19, 17 of both closure plate 3, 4 are smooth. Moreover, an annular seal 5 which is preferably formed of a thermally stable resiliently deformable sealing material, e.g. graphite for steel melts, which is stable with respect to temperature under the respective conditions of use, and resiliently deformable is positioned in the planar sealing surface 19, 17 of at least one of the two closure plates 3, 4. The sealing material should be thermally stable at least up to the melt temperature of the melt. The present device is further resistant to the entry of gas, i.e. gas-tightness, due to the presence of two channels 7, 8 in the drain block 1 rather than only one as in prior art devices. The two channels 7, 8 are oriented so as to be diametrically opposed and extend in parallel to one another. This orientation substantially improves the distribution of heat in the drain block 1 and the upper closure plate 3 which thereby drastically improves the gas tightness of the device. The gas tightness of prior art devices was insufficient due to differing thermal expansions in the drain block caused by uneven distribution of heat. The gas tightness can be further improved by the addition of more channels, e.g. a total of three. The multiple channels should be arranged uniformly along the cross section of the drain block 1. However, sufficient gas tightness can normally be obtained by a simple combination of the annular seal 5 and an individual channel. Of course, a plurality of concentric annular seals 5 can also be provided in either or both the upper or lower closure plate to improve the gas tightness.

The dimensioning of channels 7, 8 relative to the dimension of channel 6 also effects protection of the melt from the entry of gas, e.g. oxygen. The cross-sectional surface area A of the channels 7, 8 in the drain block 1 should be selected in such a way that their sum is greater than the cross-sectional surface area B of the channel 6 in the lower outlet. In this way, an appreciably lower flow rate of the melt exists in the upper part of the rotating closure as compared to the construction of prior art devices and thus vacuum pressure within the device which results in a suction effect drawing the surrounding air into the channel is accordingly reduced.

Thus, the rotating closure shown in FIG. 1 is able to protect the melt flow from the entry of gas, e.g. gas which may oxidize the melt, to effectively eliminate the need for an inert-gas shroud thereby substantially reducing the cost of the device. In addition, the drain block 1 can be more efficiently manufactured in that the channels can be arranged vertically, i.e. axially parallel to the axis of rotation 18. The two closure plates 3, 4 can thus be manufactured so as to have substantially the same shape, differing only with respect to the holding groove for the annular seal 5. In addition to its reliable operation, the rotating closure 20 according to the present invention also has a long service life and requires very small installation space as compared with prior art closure devices.

Figure 2:
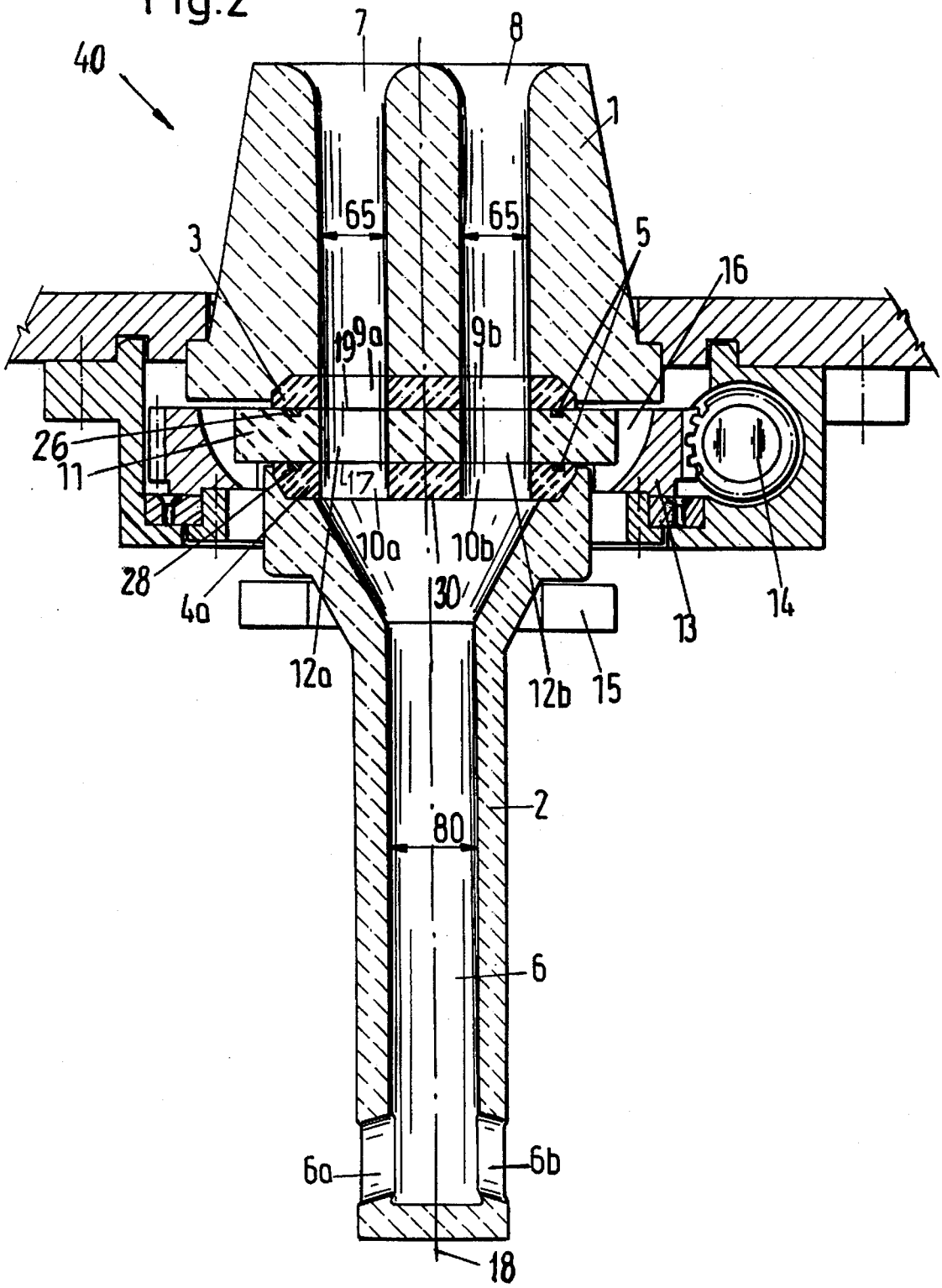
FIG. 2 shows a side cross-sectional view of a rotating closure according to the present invention for an intermediate vessel of a continuous casting installation for rectangular cross sections.

The rotating closure shown in FIG. 2 is adapted for use with rectangular ingot mold cross sections, e.g. in a continuous slab casting installation. As the basic construction and operation of this embodiment are extensively the same as that in FIG. 1 only the differences will be discussed in particular.

The lower portion of the outlet 2 is shaped differently than that of FIG. 1 as instead of a front opening 32, this embodiment includes two lateral openings 6*a*, 6*b* facing the width direction of the slab format depending on the application. The position of the openings 6*a*, 6*b* should not be changed when actuating the rotating closure 20. For this reason the outlet 2 and lower closure plate 4 should not rotate. In order to accomplish its intended purpose while keeping the outlet 2 stationary the function of the lower closure plate 4 shown in FIG. 1 is divided between a lower closure plate 4*a* and an intermediate plate 11. The intermediate plate 11 is also preferably formed of high-strength, wear-resistant refractory material and acts to effectively offset the alignment of the channels and thus close the device, preventing the melt runout from the vessel from passing through the device. The lower closure plate 4*a* carries out the function of sealing the device at the connection of the outlet 2. In this construction, the contact surfaces between the structural component parts 3, 4*a* and 11 are smooth and annular seals 5 are arranged on both sides of the intermediate plate 11. The through holes of the intermediate plate 11 corresponding to the channels 7, 8 are designated as 12*a* and 12*b*. Also, both of the holding grooves 26, 28 for the annular seals 5 can be provided in the intermediate plate 11 in contrast to the view shown in FIG. 2 so as to enable a completely identical construction for the upper and lower closure plates 3, 4*a*. FIG. 2 illustrates positioning of the holding grooves 26 in the intermediate plate 11 and positioning of the holding grooves 28 in the lower closure plate 4*a*. Instead of the two through holes 10*a*, 10*b*, a large central opening could also be provided in the lower closure plate 4*a* so as to entirely encompass at least the through holes 10*a*, 10*b* shown in FIG. 1, i.e. eliminate the central portion 30. This results in a construction of the closure plate 4*a* which is particularly simple to produce and is approximately annular in construction. This is possible because the lower closure plate 4*a* no longer performs the function of regulating the through-flow quantity of the melt.

As a result of this construction of the rotating closure 40, the outlet 2 can be fixed with respect to rotation to the same degree as the drain block 1, since the closing effect is brought about exclusively by rotation of the intermediate plate 11. This intermediate plate 11 may be supported and driven from below by a rotating body 13 constructed as a toothed wheel. Together with a driving pinion 14, preferably a toothed drive having a 45-degree toothing angle, the rotating body 13 forms a gear unit causing the intermediate plate 11 to rotate and thus effect closure of the device. Cooling slots 16 are provided for limiting the heating of this gear unit thereby permitting an effective cooling of the gear unit 13, 14 by circulating a cooling medium. The outlet 2 and the lower closure plate 4*a* are pressed upward onto a sealing seat, i.e. the lower face of the intermediate plate 11, by a pressing system 15 which is actuated mechanically or pneumatically, e.g. based on disk springs, to further improve the gas tightness of the device.

When using the rotating closure according to the present invention, it is advisable to constantly maintain an oscillating rotating movement around the respective desired open position thereby minimizing the crystallization of the melt in the region of the through holes of the lower and upper closure plate or intermediate plate when in an open state.

The invention is not limited by the embodiments described above which are presented as examples only but can be modified in various ways within the scope of protection defined by the appended patent claims.

We claim:

1. A rotating closure device having an axis of rotation for use in covering an opening in a base of a metallurgical vessel, comprising:

a drain block including at least two channels extending parallel to the axis of rotation;

an upper closure plate including at least two through holes and positioned in alignment with said at least two channels;

an outlet including at least one channel, a total cross-sectional surface area of said at least two channels is greater than a cross-sectional surface area of said at least one channel;

a lower closure plate including at least one throughhole positioned between said upper closure plate and said outlet so that said at least one channel is in alignment with said at least one throughhole and said at least two channels, both said upper and lower closure plates having a planar surface, said planar surface of said upper closure plate being in contact with said planar surface of said lower closure plate so as to provide a gas-tight seal therebetween; and at least one annular seal provided in the planar surface of at least one of said upper and lower closure plates.

2. A rotating closure device having an axis of rotation for use in covering an opening in a base of a metallurgical vessel, comprising:

a drain block (1) including at least two channels (7, 8) extending parallel to the axis of rotation;

an upper closure plate (3) including at least two through holes and positioned in alignment with said at least two channels;

an outlet (2) including at least one channel; and a lower closure plate including at least one through hole positioned between said upper closure plate and said outlet so that said at least one channel is in alignment with said at least one through hole and said at least two channels, a total cross-sectional surface area of said at least two channels being greater than a cross-sectional surface area of said at least one channel.

3. The device of claim 2, wherein said drain block and said outlet are composed of conventional refractory material.

4. The device of claim 2, wherein said upper and lower closure plates are both composed of high strength refractory material having a hardness of at least 2000 HV(Vickers Hardness).

5. The device of claim 2, wherein said outlet and lower closure plate are rotatable about said axis of rotation with respect to said drain block and upper closure plate.

6. The device of claim 5, wherein said outlet and said lower closure plate are rotatable between an open position in which said at least one through hole and said at least two channels are in communicating relationship with each other and a closed portion in which said at least one through hole and said at least two channels are not in communicating relationship.

7. The device of claim 2, wherein both said upper and lower closure plates include a planar surface, said planar surface of said upper plate being in contact with said planar surface of said lower closure plate so as to provide a gas tight seal therebetween.

8. The device of claim 7, wherein at least one of said upper and lower closure plates includes at least one annular seal.

9. The device of claim 8, wherein said at least one annular seal is composed of a thermally stable resiliently deformable material.

10. The device of claim 9, wherein said at least one annular seal is composed of graphite.

11. A rotating closure device having an axis of rotation for use in covering an opening in a base of a metallurgical vessel, comprising:

a drain block (1) including at least two channels (7, 8) extending parallel to the axis of rotation;

an upper closure plate (3) including at least two through holes and positioned in alignment with said at least two channels;

an outlet (2) including at least one channel;

a lower closure plate including at least one through hole positioned between said upper closure plate and said outlet so that said at least one channel is in alignment with said at least one through hole and said at least two channels;

an intermediate plate including at least two through holes positioned between said upper and lower closure plates and rotatable about said axis of rotation between an open position in which said at least two through holes of said intermediate plate are in a communicating relationship with said at least two through holes of said upper closure plate and a closed position in which said at least two through holes are offset from said at least two through holes of said upper closure plate; and first and second annular seals each positioned on a respective side of said intermediate plate.

12. The device of claim 11, further comprising a sealing seat; and a pressing system for exerting a force on said outlet and lower closure plate towards said intermediate plate pressing said outlet and lower closure plate against said sealing seat.

13. The device of claim 11, wherein said intermediate plate is composed of a high-strength, wear resistant refractory material.

14. The device of claim 11, further comprising a rotating body including a toothed heel for supporting and rotating said intermediate plate.

15. The device of claim 14, further comprising cooling slots for controlling heating of said rotating body.

* * * * *